US011750974B2

(12) United States Patent
Cao et al.

(10) Patent No.: US 11,750,974 B2
(45) Date of Patent: Sep. 5, 2023

(54) SOUND PROCESSING METHOD, ELECTRONIC DEVICE AND STORAGE MEDIUM

(71) Applicants: Beijing Xiaomi Mobile Software Co., Ltd., Beijing (CN); Beijing Xiaomi Pinecone Electronics Co., Ltd., Beijing (CN)

(72) Inventors: Chenbin Cao, Beijing (CN); Mengnan He, Beijing (CN)

(73) Assignees: Beijing Xiaomi Mobile Software Co., Ltd., Beijing (CN); Beijing Xiaomi Pinecone Electronics Co., Ltd., Beijing (CN)

( * ) Notice: Subject to any disclaimer, the term of this patent is extended or adjusted under 35 U.S.C. 154(b) by 104 days.

(21) Appl. No.: 17/646,401

(22) Filed: Dec. 29, 2021

(65) Prior Publication Data

US 2023/0007393 A1 Jan. 5, 2023

(30) Foreign Application Priority Data

Jun. 30, 2021 (CN) ..... 202110739195.1

(51) Int. Cl.
*H04R 3/04* (2006.01)
*G10L 21/0216* (2013.01)
(Continued)

(52) U.S. Cl.
CPC ..... *H04R 3/04* (2013.01); *G10L 21/0216* (2013.01); *G10L 25/21* (2013.01); *G10L 25/78* (2013.01); *G10L 2021/02165* (2013.01)

(58) Field of Classification Search
CPC ..... H04R 3/04; G10L 21/0216; G10L 25/21; G10L 25/78; G10L 2021/02165;
(Continued)

(56) References Cited

U.S. PATENT DOCUMENTS 8,467,543 B2 * 6/2013 Burnett ..... G10L 25/78 704/226
8,898,058 B2 * 11/2014 Shin ..... G10L 25/78 704/214
(Continued)

FOREIGN PATENT DOCUMENTS

WO 2019112468 A1 6/2019

OTHER PUBLICATIONS

"Kalman filter," Wikipedia Website, Available Online at https://en.wikipedia.org/wiki/Kalman_filter, Available as Early as Feb. 8, 2003, 36 pages.
(Continued)

*Primary Examiner* — Xu Mei
(74) *Attorney, Agent, or Firm* — McCoy Russell LLP

(57) ABSTRACT

A sound processing method includes: determining a vector of a first residual signal according to a first signal vector and a second signal vector, the first signal vector including a first voice signal and a first noise signal input into the first microphone, the second signal vector including a second voice signal and a second noise signal input into the second microphone, and the first residual signal including the second noise signal and a residual voice signal; determining a gain function of a current frame according to the vector of the first residual signal and the first signal vector; and determining a first voice signal of the current frame according to the first signal vector and the gain function of the current frame.

20 Claims, 3 Drawing Sheets

(51) Int. Cl.
*G10L 25/21* (2013.01)
*G10L 25/78* (2013.01)

(58) Field of Classification Search
CPC ..... G10L 21/0232; G10L 21/0208; G10L 2021/02082
USPC ..... 381/94.7, 91, 92, 122, 98, 110; 704/222, 704/226–228
See application file for complete search history.

(56) References Cited

U.S. PATENT DOCUMENTS

| | | | | |
|---|---|---|---|---|
| 11,064,296 | B2 * | 7/2021 | Wang | H04R 3/005 |
| 2006/0217973 | A1 * | 9/2006 | Gao | G10L 25/78 704/E11.003 |
| 2010/0128894 | A1 * | 5/2010 | Petit | G10L 25/93 381/92 |
| 2013/0218559 | A1 * | 8/2013 | Yamabe | G10L 21/0216 704/226 |
| 2014/0126743 | A1 * | 5/2014 | Petit | H04R 3/005 381/92 |
| 2015/0279388 | A1 * | 10/2015 | Taenzer | G10L 15/20 704/226 |

OTHER PUBLICATIONS

Welch, G. et al., "An Introduction to the Kalman Filter," Technical Report 95-041, Department of Computer Science, University of North Carolina—Chapel Hill, vol. 95, No. 41, Jul. 24, 2006, 16 pages.

* cited by examiner

SOUND PROCESSING METHOD, ELECTRONIC DEVICE AND STORAGE MEDIUM

CROSS-REFERENCE TO RELATED APPLICATION

The present application claims priority to Chinese Patent Application No. 2021107391951, filed on Jun. 30, 2021. The entire contents of the above-listed application is hereby incorporated by reference for all purposes.

BACKGROUND

When terminal devices such as mobile phones perform voice communication and human-machine voice interaction, when a user inputs voice into a microphone, noise will also enter the microphone synchronously, thus forming an input signal in which voice signals and noise signals are mixed. In the related art, an adaptive filter is used to eliminate the above-mentioned noise, but the adaptive filter has a poor effect on noise elimination, so a purer voice signal cannot be obtained.

SUMMARY

According to a first aspect of an example of the present disclosure, a sound processing method is provided, applied to a terminal device. The terminal device includes a first microphone and a second microphone, and the method includes:

determining a vector of a first residual signal according to a first signal vector and a second signal vector, the first signal vector being input signals of the first microphone and including a first voice signal and a first noise signal, the second signal vector being input signals of the second microphone and including a second voice signal and a second noise signal, and the first residual signal including the second noise signal and a residual voice signal;

determining a gain function of a current frame according to the vector of the first residual signal and the first signal vector; and determining a first voice signal of the current frame according to the first signal vector and the gain function of the current frame.

According to a second aspect of an example of the present disclosure, an electronic device is provided, including a memory, a processor, a first microphone and a second microphone. The memory is configured to store a computer instruction that may be run on the processor, the processor is configured to realize a sound processing method when executing the computer instruction, and the sound processing method includes:

determining a vector of a first residual signal according to a first signal vector and a second signal vector, the first signal vector including a first voice signal and a first noise signal input into the first microphone, the second signal vector including a second voice signal and a second noise signal input into the second microphone, and the first residual signal including the second noise signal and a residual voice signal;

determining a gain function of a current frame according to the vector of the first residual signal and the first signal vector; and determining a first voice signal of the current frame according to the first signal vector and the gain function of the current frame.

According to a third aspect of an example of the present disclosure, a non-transitory computer readable storage medium is provided, storing a computer program. The program realizes a sound processing method when being executed by a processor. The method is applied to a terminal device, the terminal device includes a first microphone and a second microphone, and the method includes:

determining a vector of a first residual signal according to a first signal vector and a second signal vector, the first signal vector including a first voice signal and a first noise signal input into the first microphone, the second signal vector including a second voice signal and a second noise signal input into the second microphone, and the first residual signal including the second noise signal and a residual voice signal;

determining a gain function of a current frame according to the vector of the first residual signal and the first signal vector; and determining a first voice signal of the current frame according to the first signal vector and the gain function of the current frame.

It should be understood that the above general description and following detailed descriptions are merely exemplary and explanatory and do not limit the present disclosure.

BRIEF DESCRIPTION OF THE FIGURES

The drawings herein are incorporated into the specification and constitute a part of the specification, show examples in accordance with the present disclosure, and together with the specification are used to explain the principle of the present disclosure.

DETAILED DESCRIPTION

Figure 1:
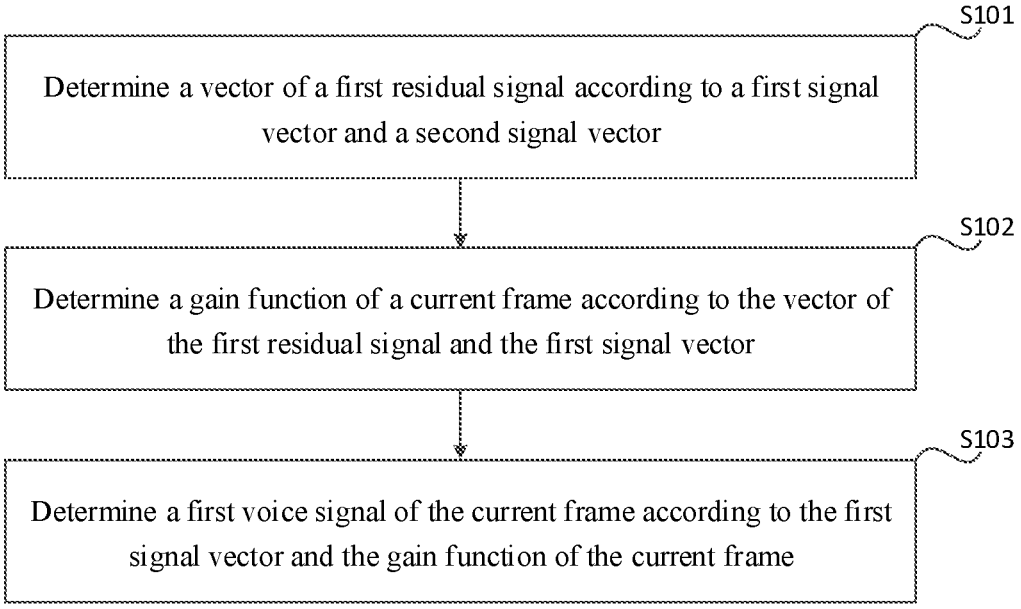
FIG. 1 is a flow chart of a sound processing method shown by an example of the present disclosure.

Some examples will be described in detail here, and their instances are shown in the accompanying drawings. When the following description refers to the accompanying drawings, unless otherwise indicated, the same numbers in different drawings represent the same or similar elements. The implementations described in the following examples do not represent all implementations consistent with the present disclosure. Rather, they are merely examples of an apparatus and a method consistent with some aspects of the present disclosure.

The terms used in the present disclosure are only for the purpose of describing specific examples, and are not intended to limit the present disclosure. Singular forms of "a", "said" and "the" used in the present disclosure are also intended to include plural forms, unless the context clearly indicates other meanings. It should also be understood that the term "and/or" used herein refers to and includes any or all possible combinations of one or more associated listed items.

It should be understood that although the terms first, second, third, etc. may be used in the disclosure to describe various information, the information should not be limited to these terms. These terms are only used to distinguish the same type of information from each other. For example, without departing from the scope of the present disclosure, first information may also be referred to as second information, and similarly, second information may also be referred to as first information. Depending on the context, the word "if" used herein may be interpreted as "at the moment of" or "when" or "in response to determining".

Traditional noise suppression methods on mobile phones are generally based on structures of adaptive blocking matrix (BM), adaptive noise canceller (ANC), and post-filtering (PF). The adaptive blocking matrix eliminates a target voice signal in an auxiliary channel and provides a noise reference signal for the ANC. The adaptive noise canceller eliminates a coherent noise in a main channel. Post-filtering estimates a noise signal in an ANC output signal, and uses spectral enhancement methods such as MMSE or Wiener filtering to further suppress a noise, thus obtaining an enhanced signal with a higher signal-to-noise ratio (SNR).

Traditional BM and ANC are usually realized by using NLMS or RLS adaptive filters. An NLMS algorithm needs to design a variable step size mechanism to control an adaptive rate of a filter to achieve the objective of fast convergence and smaller steady-state errors at the same time, but this objective is almost impossible for practical applications. An RLS algorithm does not need to additionally design variable step sizes, but it does not consider a process noise; and under an influence of actions such as holding and moving of a mobile phone, a transfer function between two microphone channels may frequently change, so a rapid update strategy of an adaptive filter is required. The RLS algorithm is not so robust in dealing with the two problems. The ANC is only applicable to processing the coherent noises in general, that is, a noise source is relatively close to the mobile phone, and direct sound from the noise source to the microphones prevails. A noise environment of mobile phone voice calls is generally a diffuse field, that is, a plurality of noise sources are far away from the microphones of the mobile phone and require multiple spatial reflections to reach the mobile phone. Thus, the ANC is almost ineffective in practical applications.

Based on that, in a first aspect, at least one example of the present disclosure provides a sound processing method. With reference to FIG. 1 which shows a flow of the method, the method includes step S101 to step S104.

The sound processing method is applied to a terminal device, and the terminal device may be a mobile phone, a tablet computer or other terminal devices with a communication function and/or a man-machine interaction function. The terminal device includes a first microphone and a second microphone. The first microphone is located at a bottom of the mobile phone, serves as a main channel, is mainly configured to collect a voice signal of a target speaker, and has a higher signal-to-noise ratio (SNR). The second microphone is located at a top of the mobile phone, serves as an auxiliary channel, is mainly configured to collect an ambient noise signal, including part of voice signals of the target speaker, and has a lower SNR. The purpose of the sound processing method is to use an input signal of the second microphone to eliminate noise from an input signal of the first microphone, thus obtaining a relatively pure voice signal.

The input signals of the microphones are each composed of a near-end signal and a stereo echo signal:

$$d_1(n)=s_1(n)+v_1(n)+y_1(n)$$

$$d_2(n)=s_2(n)+v_2(n)+y_2(n)$$

where subscripts $i=\{1,2\}$ represent microphone indexes, 1 is the main channel, 2 is the auxiliary channel, $d_i(n)$ is an input signal of a microphone, a signal of a near-end speaker $s_i(n)$ and a background noise $v_i(n)$ constitute a near-end signal and $y_i(n)$ is an echo signal. Because noise elimination and suppression is usually performed in an echo-free period or in a case that an echo has been eliminated, an influence of the echo signals does not need to be considered in a subsequent process.

Voice calls are generally used in near-field scenarios, that is, a distance between the target speaker and the microphones of the mobile phone is relatively short, and a relationship between target speaker signals picked up by the two microphones may be expressed through acoustic impulse response (AIR):

$$s_2(n)=h_t(n)s_1(n-t)=h^T(n)s_1(n)$$

where $s_1(n)$ and $s_2(n)$ respectively represents the target speaker signals of the main channel and the auxiliary channel, h(n) is an acoustic transfer function between them, $h(n)=[h_0, h_1, \ldots, h_{L-1}]^T$, L is a length of the transfer function, and $s_1(n)=[s_1(n), s_1(n-1), \ldots, s_1(n-L+1)]^T$ is a vector form of the target speaker signal of the main channel.

For diffuse field noise signals picked up by the two microphones, a relationship between them cannot be simply expressed through the acoustic impulse response, but noise power spectra of the two microphones are highly similar, so a long-term spectral regression method may be used for modeling.

$$V_1(n)=\Sigma_{i=0}^{N-1}\Sigma_{t_i=i\cdot L}^{(i+1)\cdot L-1}h_{i,t_i}(n)V_2(n-t_i)$$

where $V_1(n)$ and $V_2(n)$ respectively represents noise power spectra of the main channel and the auxiliary channel, and $h_{i,t}(n)$ is a relative convolution transfer function between them.

In step S101, a vector of a first residual signal is determined according to a first signal vector and a second signal vector. The first signal vector includes a first voice signal and a first noise signal input into the first microphone, the second signal vector includes a second voice signal and a second noise signal input into the second microphone, and the first residual signal includes the second noise signal and a residual voice signal.

The first microphone and the second microphone are in a same environment, so a signal source of the first voice signal and a signal source of the second voice signal are identical, but a difference between distances from the signal source to the two microphones causes a difference between the first voice signal and the second voice signal. Similarly, a signal source of the first noise signal and a signal source of the second noise signal are identical, but the difference between distances from the signal source to the two microphones causes a difference between the first noise signal and the second noise signal. The first residual signal may be obtained from the input signals of the two microphones through an offset manner. The first residual signal approximates a noise signal of the auxiliary channel, that is, the second noise signal.

In step S102, a gain function of a current frame is determined according to the vector of the first residual signal and the first signal vector.

The gain function is used to perform differential gain on the first residual signal, that is, perform forward gain on the first voice signal in the first residual signal, and perform backward gain on the second voice signal in the first residual signal. Thus, an intensity difference between the first voice signal and the first noise signal is increased, and the signal-to-noise ratio is increased, thus obtaining a pure first voice signal to the greatest extent.

In step S103, a first voice signal of the current frame is determined according to the first signal vector and the gain function of the current frame.

In the step, a product of multiplying the first signal vector by the gain function of the current frame may be converted from a frequency domain form to a time domain form, so as to form the first voice signal of the current frame in the time domain form. For example, a form of inverse Fourier transform as follows may be adopted to perform the conversion from the frequency domain form to the time domain form:

$$e=ifft(D_1(l).*G(l)).*win$$

where $D_1(l)$ and $G(l)$ are respectively vector forms of $D_1(l, k)$ and $G(l, k)$, e is a time domain enhanced signal with noise eliminated, and if ft(•) is inverse Fourier transform.

In the present disclosure, the first residual signal including the second noise signal and the residual voice signal is determined according to the first signal vector composed of the first voice signal and the first noise signal which are input into the first microphone as well as the second signal vector composed of the second voice signal and the second noise signal which are input into the second microphone; then the gain function of the current frame is determined according to the vector of the first residual signal and the first signal vector; and finally the first voice signal of the current frame is determined according to the first signal vector and the above-mentioned gain function of the current frame. Because the first microphone and the second microphone are at different locations, their ratios of voices to noises are in opposite trends. Thus, noise estimation and suppression may be performed for the first signal vector and the second signal vector by using a target voice and interference noise offsetting method, thus improving an effect of eliminating noises in the microphone, and a pure voice signal may be obtained.

Figure 2:
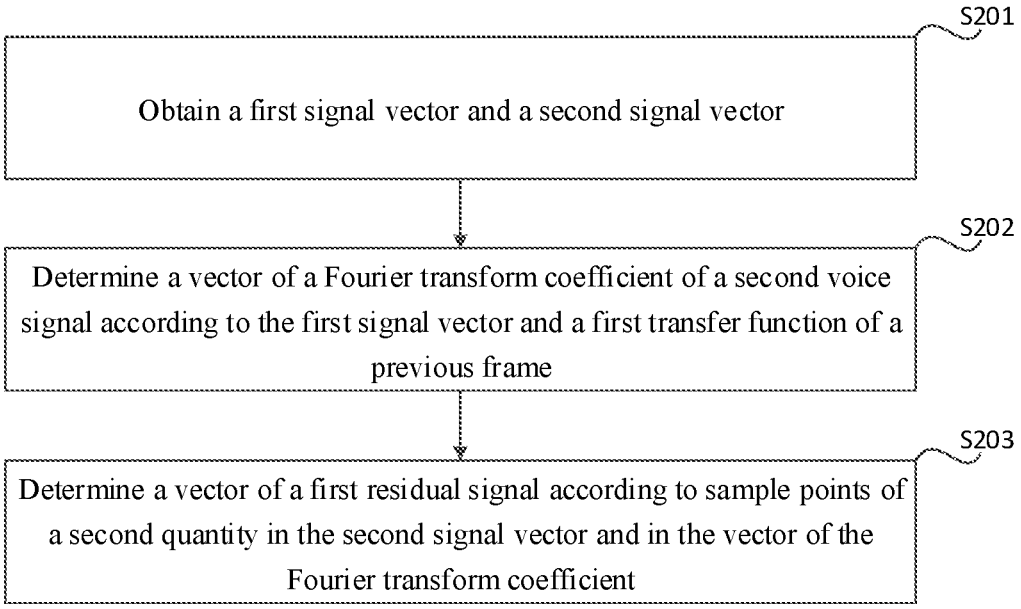
FIG. 2 is a flow chart of determining a vector of a first residual signal shown by an example of the present disclosure.

In some examples of the present disclosure, the vector of the first residual signal may be determined according to the first signal vector and the second signal vector in the manner shown in FIG. 2, including step S201 to step S203.

In step S201, the first signal vector and the second signal vector are obtained. The first signal vector includes sample points of a first quantity, and the second signal vector includes sample points of a second quantity.

In the step, an input signal of a current frame of the first microphone and an input signal of at least one previous frame of the first microphone may be spliced to form the first signal vector with the quantity of sample points being the first quantity. The first quantity M may represent a length of a spliced signal block. Optionally, signal splicing is performed by using a continuous frame overlap manner to obtain the first signal vector $d_1(l)$:

$$d_1(l)=[d_1(n), d_1(n-1), \ldots, d_1(n-M+1)]^T$$

where $d_1(n)$, $d_1(n-1)$, . . . , $d_1(n-M+1)$ are M sample points, and M may be an integer multiple of the quantity R of sample points of each frame of signal.

In the step, an input signal of a current frame of the second microphone and an input signal of at least one previous frame of the second microphone are spliced to form the second signal vector with the quantity of sample points being the second quantity. The second quantity R may represent a length of each frame of signal. Optionally, signal splicing is performed by using a continuous frame overlap manner to obtain the second signal vector $d_2(l)$:

$$d_2(l)=[d_2(n), d_2(n-1), \ldots, d_2(n-R+1)]^T$$

where $d_2(n)$, $d_2(n-1)$, . . . , $d_2(n-R+1)$ are R sample points.

In step S202, a vector of a Fourier transform coefficient of the second voice signal is determined according to the first signal vector and a first transfer function of a previous frame.

In the step, $d_1(l)$ may be converted from a time domain to a frequency domain first, so as to obtain a DFT coefficient of a main channel input signal $D_1(l, k)$: $D_1(l)=fft(d_1(l))$; and then the vector $\hat{S}_2(l)$ of the Fourier transform coefficient of the second voice signal is determined according to $D_1(l, k)$ and the first transfer function of the previous frame $\hat{W}_s(l-1, k)$ based on the following formula: $\hat{S}_2(l)=D_1(l)\hat{W}_s(l=1, k)$ In step S203, the vector of the first residual signal is determined according to the sample points of the second quantity in the second signal vector and in the vector of the Fourier transform coefficient.

In the step, $\hat{S}_2(l)$ may be converted from a frequency domain to a time domain first: $\hat{s}_2(l)=ifft(\hat{S}_2(l))$, and then the vector v(l) of the first residual signal is obtained based on the following formula: $v(l)=d_2(l)-\hat{s}_2(l, M-R+1:M)$.

Further, after v(l)is obtained, a first transfer function of the current frame may be updated in the following manner.

First, a first Kalman gain coefficient $K_S(l)$ is determined according to the vector v(l) of the first residual signal, residual signal covariance $\phi_V(l-1)$ of the previous frame, state estimation error covariance $P_V(l-1)$ of the previous frame, the first signal vector $D_1(l)$ and a smoothing parameter $\alpha$.

The first Kalman gain coefficient $K_S(l)$ may be obtained based on the following formulas in sequence:

$$V(l) = fft([0; v(l)]),\ \phi_V(l) = \alpha\phi_V(l-1) + (1-\alpha)|V(l)|^2,$$

$$\text{and } K_S(l) = A \cdot P_V(l-1)D_1^*(l)\left[D_1^*(l) + \frac{M}{R}\phi_V(l)\right]^{-1},$$

where A is a transition probability and generally takes a value $0<<A<1$.

Then the first transfer function $\hat{W}_S(l)$ of the current frame may be determined according to the first Kalman gain coefficient $K_S(l)$, the first residual signal V(l), and the first transfer function $\hat{W}_S(l-1)$of the previous frame.

The first transfer function of the current frame may be obtained based on the following formulas in sequence: $\Delta W_{SU}=K_S(l)V(l)$, $\Delta w_s=ifft(\Delta W_{SU})$, $\Delta W_{SC}=fft([\Delta w_s(1:M-R); 0])$, and $\hat{W}_S(l)=W_S(l-1)+\Delta W_{SC}$.

By updating the first transfer function of the current frame, it can be utilized for processing a next frame of signal, because relative to the next frame of signal, the first transfer function of the current frame is the first transfer function of the previous frame. It should be noted that when a processed signal is the first frame, the first transfer function of the previous frame may be randomly preset.

In addition, after v(l) is obtained, a residual signal covariance of the current frame is updated based on the following manner: the residual signal covariance of the current frame is determined according to the first transfer function of the current frame, the first transfer function covariance of the previous frame, the first Kalman gain coefficient, the residual signal covariance of the previous frame, the first quantity and the second quantity.

The residual signal covariance $P_V(l)$ of the current frame may be obtained based on the following formulas in sequence:

$$\phi_{WS}(l) = \alpha\phi_{WS}(l-1) + (1-\alpha)\left|\hat{W}_S(l)\right|^2,\ \phi_\Delta(l) = \left(1-A^2\right)\phi_{WS}(l),$$

$$\text{and } P_V(l) = A\cdot\left[A\cdot I - \frac{M}{R}K(l)D_1(l)\right]P_V(l-1) + \phi_\Delta(l),$$

where $\phi_{WS}(l)$ is a covariance of a relative transfer function of a voice between the channels, $\alpha$ is the smoothing parameter, $\phi_\Delta(l)$ is a process noise covariance, $P_V(l)$ is the state estimation error covariance, and $I=[1,1, \ldots 1]^T$ is a vector composed of 1.

By updating the residual signal covariance of the current frame, it can be utilized for processing the next frame of signal, because relative to the next frame of signal, the residual signal covariance of the current frame is the residual signal covariance of the previous frame. It should be noted that when the processed signal is the first frame, the residual signal covariance of the previous frame may be randomly preset.

Figure 3:
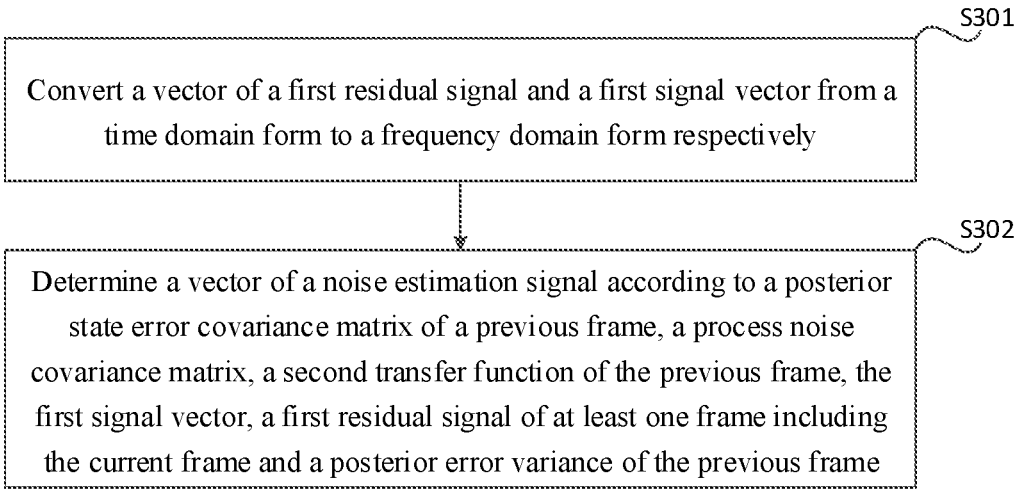
FIG. 3 is a flow chart of determining a vector of a gain function shown by an example of the present disclosure.

In some examples of the present disclosure, the gain function of the current frame may be determined according to the vector of the first residual signal and the first signal vector in the manner shown in FIG. 3, including step S301 to step S303.

In step S301, the vector of the first residual signal and the first signal vector are converted from a time domain form to a frequency domain form respectively.

Figure 4:
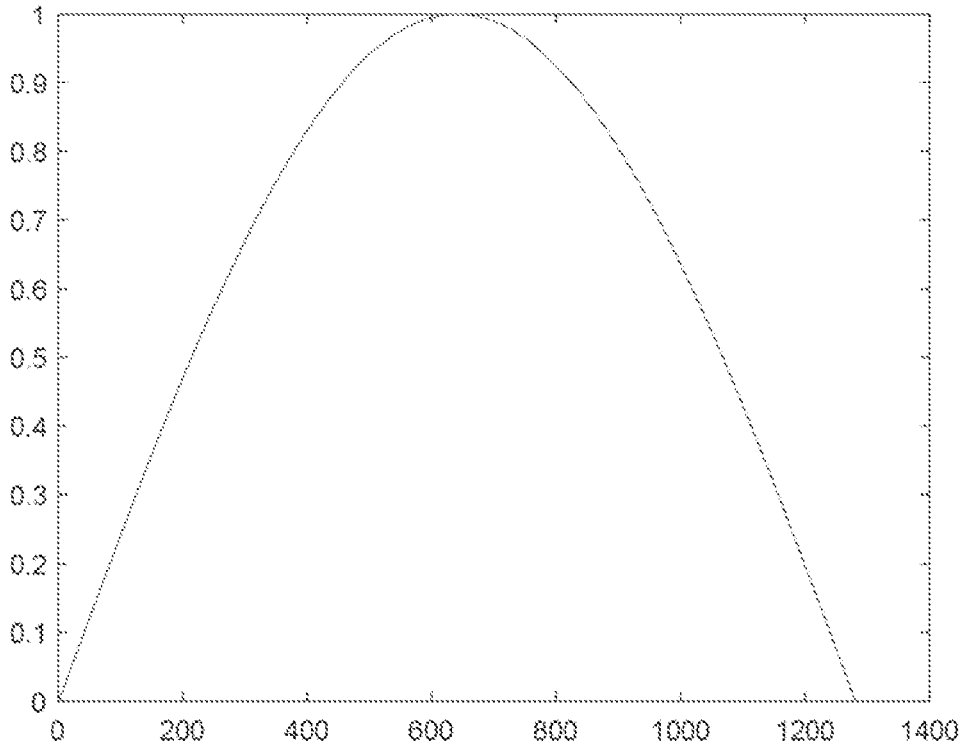
FIG. 4 is a schematic diagram of an analysis window shown by an example of the present disclosure.

The conversion from the time domain form to the frequency domain form may be performed based on Fourier transform as follows:

$$V_2(l)=fft(v_2.*\ win)$$

$$D_1(l)=fft(d_1.*\ win)$$

where $v_2(l)$ is first residual signal containing N sample points, $d_1(l)$ is the main channel input signal, i.e. the first signal vector, win is a short-term analysis window, and fft(•) is Fourier transform.

$$v_2(l)=[v(n),\ v(n-1),\ \ldots,\ v(n-N+1)]^T$$

$$d_1(l)=[d_1(n),\ d_1(n-1),\ \ldots,\ d_1(n-N+1)]^T$$

$$win=[0;\ \mathrm{sqrt}(\mathrm{hanning}(N-1))]$$

$$\mathrm{hanning}(n)=0.5\ [1-\cos\ (2\ \pi*n/N)]$$

where N is a length of an analysis frame, hanning(n) is a hanning window with a length of N−1 as shown in FIG. 4.

In step S302, a vector of a noise estimation signal is determined according to a posterior state error covariance matrix of the previous frame, a process noise covariance matrix, a second transfer function of the previous frame, the first signal vector, a first residual signal of at least one frame including the current frame and a posterior error variance of the previous frame.

In the step, an apriori state error covariance matrix $P(l|l-1, k)$ of the previous frame may be first determined according to the posterior state error covariance matrix of the previous frame and the process noise covariance matrix: $P(l|l-1, k)=\hat{P}(l-1, k)\Phi+_\Delta(l, k)$, where $\hat{P}(l-1, k)$ is the posterior state error covariance matrix of the previous frame, $\Phi_\Delta(l, k)$ is the process noise covariance matrix, $\Phi_\Delta(l, k)=\sigma_\Delta^2(l, k)I$, $\sigma_\Delta^2(l, k)$ is a parameter for controlling an uncertainty of the first transfer function g(l, k) and may take a value $\sigma_{w\Delta}^2(l, k)=1e^{-4}$, and 1 is a unit matrix. When the current frame is the first frame, the posterior state error covariance matrix of the previous frame may adopt a preset initial value.

Then, a vector of an apriori error signal $E(l|l-1, k)$ of the previous frame and an apriori error variance $\hat{\psi}_E(l|l-1, k)$ of the previous frame are determined according to the first signal vector, the second transfer function of the previous frame, and vectors of first residual signals of the current frame and previous L−1 frames: $E(l|l-1, k)=D_1(l, k)-V_2^T(l,k)\hat{g}(l-1, k)$, and $\hat{\psi}_E(l|l-1, k)=|D_1k)\hat{g}(l-1, k)|^2$, where $V_2(l, k)=[V(l, k), V(l-1, k), \ldots, V(l-L+1, k)]^T$, L is a length of the second transfer function g(l, k), and the second transfer function is a transfer function between echo estimation and a residual echo. When the current frame is the first frame, the second transfer function of the previous frame may adopt a preset initial value. In the vectors of the first residual signals of the current frame and the previous L−1 frames, if there is no L−1 frames before the current frame, the quantity of lacking frames may adopt a preset initial value.

Then, a vector $\hat{\Phi}_E(l, k)$ of a prediction error power signal of the current frame is determined according to the posterior error variance of the previous frame and the apriori error variance of the previous frame: $\hat{\Phi}_E(l, k)=\beta\hat{\psi}_E(l-1, k)+(1-\beta)\hat{\psi}_E(l|l-1, k)$, where $\hat{\psi}_E(l, k)$ is the posterior error variance, $\hat{\psi}_E(l|l-1, k)$ is the apriori error variance, $i\hat{\psi}_E(l|l-1, k)=|E_1(l, k), Y_1^T(l, k)\hat{g}(l-1, k)|^2$, $\beta$ is a forgetting factor, and $0\leq\beta\leq1$. When the current frame is the first frame, the posterior error variance of the previous frame and the apriori error variance of the previous frame may both adopt preset initial values.

Then, a second Kalman gain coefficient K(l, k) is determined according to the apriori state error covariance matrix of the previous frame, the vectors of the first residual signals of the current frame and the previous L−1 frames, and the vector of the prediction error power signal of the current frame: $K(l, k)=P(l|l-1, k)V^*_2(l, k)[V_2^T(l, k)P(l|l-1, k)V^*_2(l, k)+\hat{\phi}(l, k)]^{-1}$. When the current frame is the first frame, the apriori state error covariance matrix of the previous frame may adopt a preset initial value. In the vectors of the first residual signals of the current frame and the previous L−1 frames, if there is no L−1 frames before the current frame, the quantity of lacking frames may adopt a preset initial value.

Then, a second transfer function of the current frame is determined according to the second Kalman gain coefficient, the vector of the apriori error signal of the previous frame, and the second transfer function of the current frame: $\hat{g}(l, k)=\hat{g}(l-1, k)+K(l, k)E(l|l-1, k)$. When the current frame is the first frame, the second transfer function of the previous frame may adopt a preset initial value.

Finally, the vector $\hat{\phi}_R(l, k)$ of the noise estimation signal is determined according to a vector of a prediction error power signal of the previous frame, the vectors of the first residual signals of the current frame and the previous L−1 frames, and the second transfer function of the current frame: $\hat{\phi}_R(l, k)=\lambda\hat{\phi}_E(l-1, k)+(1-\ )|V_2^T(l, k)\hat{g}(l, k)|^2$, where $\lambda$ is a forgetting factor, and $0\leq\lambda\leq1$. When the current frame is the first frame, the vector of the prediction error power signal of the previous frame may adopt a preset initial value. In the vectors of the first residual signals of the current frame and the previous L−1 frames, if there is no L−1 frames before the current frame, the quantity of lacking frames may adopt a preset initial value.

In addition, a posterior state error covariance matrix $\hat{P}(l, k)$ of the current frame may also be determined according to the second Kalman gain coefficient, the vectors of the first residual signals of the current frame and the previous L−1 frames, and the apriori state error covariance matrix of the previous frame: $\hat{P}(l, k)=[I-K(l, k)V_2^T(l, k)]P(l|l-1, k)$. When the current frame is the first frame, the apriori state error covariance matrix of the previous frame may adopt a preset initial value. In the vectors of the first residual signals of the current frame and the previous L−1 frames, if there is no L−1 frames before the current frame, the quantity of lacking frames may adopt a preset initial value.

A posterior error variance $\hat{\psi}(l, k)$ of the current frame may also be determined according to the first signal vector, the vectors of the first residual signals of the current frame and the previous L−1 frames, and the apriori state error covariance matrix of the previous frame: $\hat{\psi}_E(l, k)=|D_1(l, k)-V_2^T(l, k)\hat{g}(l, k)|^2$. When the current frame is the first frame, the apriori state error covariance matrix of the previous frame may adopt a preset initial value. In the vectors of the first residual signals of the current frame and the previous L−1 frames, if there is no L−1 frames before the current frame, the quantity of lacking frames may adopt a preset initial value.

In step S302, the gain function of the current frame is determined according to the vector of the noise estimation signal, a vector of a first estimation signal of the previous frame, a vector of a voice power estimation signal of the previous frame, a gain function of the previous frame, the first signal vector and a minimum apriori signal to interference ratio.

In the step, a vector $\hat{\phi}_D(l, k)$ of a first estimation signal of the current frame may be first determined according to the vector of the first estimation signal of the previous frame and the first signal vector: $\hat{\psi}_D(l, k)=\lambda\hat{\phi}_D(l-1, k)+(1-\lambda)|D_1(l, k)|^2$. When the current frame is the first frame, the vector of the first estimation signal of the previous frame may adopt a preset initial value.

Then, a vector $\hat{\phi}_S(l, k)$ of a voice power estimation signal of the current frame is determined according to the vector of the voice power estimation signal of the previous frame, the first signal vector and the gain function of the previous frame: $\hat{\psi}_D(l, k)=\lambda\hat{\phi}_D(l-1, k)+(1-\lambda)|D_1(l, k)|^2$. When the current frame is the first frame, the vector of the voice power estimation signal of the previous frame may adopt a preset initial value.

Then, a posterior signal to interference ratio $\gamma(l, k)$ is determined according to the vector of the first estimation signal of the current frame and a vector of a noise estimation signal of the current frame:

$$\gamma(l, k) = \frac{\hat{\phi}_Y(l, k)}{\hat{\phi}_R(l, k)}.$$

Finally, the gain function $G(l, k)$ of the current frame is determined according to the vector of the voice power estimation signal of the current frame, the vector of the noise estimation signal of the current frame, the posterior signal to interference ratio and the minimum apriori signal to interference ratio:

$$G(l, k) = \sqrt{\frac{\xi(l, k)}{1 + \xi(l, k)}},$$

where $$\xi(l, k) = \eta\frac{\hat{\phi}_S(l, k)}{\hat{\phi}_R(l, k)} + (1 - \eta)\max\{\gamma(l, k) - 1, \xi_{min}\},$$

$\eta$ is a forgetting factor, and $\xi_{min}$ is the minimum apriori signal to interference ratio, used to control a residual echo suppression amount and a musical noise.

An ambient noise used by the mobile phone is a diffuse field noise, and a correlation between the noise signals picked up by the two microphones of the mobile phone is low, while a target voice signal has a strong correlation. Thus, a linear adaptive filter may be used to estimate a target voice component of a signal of a reference microphone (the second microphone) through a signal of a main microphone (the first microphone), and eliminate it from the reference microphone, thus providing a reliable reference noise signal for a noise estimation process in a speech spectrum enhancement period.

A Kalman adaptive filter has the features of high convergence speed, small filter offset, etc. A complete diagonalization fast frequency domain implementation method of a time-domain Kalman adaptive filter is used to eliminate the target voice signal, including several processes such as filtering, error calculation, Kalman update and Kalman prediction. The filtering process is to use the target voice signal of the main microphone to estimate the target voice component in the reference microphone through an estimation filter, and then subtract it from the reference microphone signal to work out an error signal, that is, the reference noise signal. Kalman update includes calculation of Kalman gain and filter adaptation. Kalman prediction includes calculation of relative transfer function covariance between the channels, process noise covariance and state estimation error covariance. Compared with traditional adaptive filters such as NLMS, the Kalman filter has a simple adaption process and does not require a complicated step size control mechanism. The complete diagonalization fast frequency domain implementation method is simple to calculate, which further reduces the computational complexity.

An STFT domain Kalman adaptive filter is used to estimate a relative convolution transfer function between noise spectra of the two microphones, so as to estimate a noise spectrum in the main microphone signal through the reference noise signal of the reference microphone, a Wiener filter spectrum enhancement method is used to suppress the noise, and finally an ISTFT method is used to synthesize and enhance the voice signal. The implementation process of STFT domain Kalman adaptive filtering is similar to that of a complete diagonalization fast frequency domain implementation process of the Kalman adaptive filter in target voice signal offset. The difference is that the former implements Kalman adaptive filtering in an STFT domain, and the latter is complete diagonalization fast frequency domain implementation of the time-domain Kalman adaptive filter.

Figure 5:
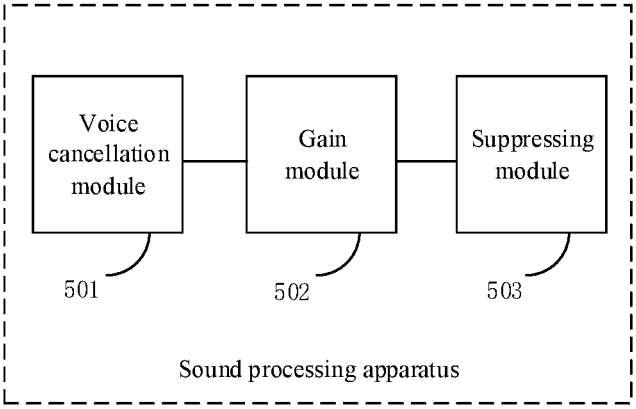
FIG. 5 is a schematic structural diagram of a sound processing apparatus shown by an example of the present disclosure.

According to a second aspect of an example of the present disclosure, a sound processing apparatus is provided, applied to a terminal device. The terminal device includes a first microphone and a second microphone. With reference to FIG. 5, the apparatus includes:

a voice cancellation module 501, configured to determine a vector of a first residual signal according to a first signal vector and a second signal vector, the first signal vector being input signals of the first microphone and including a first voice signal and a second noise signal, the second signal vector being input signals of the second microphone and including a second voice signal and a second noise signal, and the first residual signal including the second noise signal and a residual voice signal;

a gain module 502, configured to determine a gain function of a current frame according to the vector of the first residual signal and the first signal vector; and a suppressing module 503, configured to determine a first voice signal of the current frame according to the first signal vector and the gain function of the current frame.

In some examples of the present disclosure, the voice cancellation module is specifically configured to:

obtain the first signal vector and the second signal vector, the first signal vector including sample points of a first quantity, and the second signal vector including sample points of a second quantity;

determine a vector of a Fourier transform coefficient of the second voice signal according to the first signal vector and a first transfer function of a previous frame; and determine the vector of the first residual signal according to the sample points of the second quantity in the second signal vector and in the vector of the Fourier transform coefficient.

In some examples of the present disclosure, the voice cancellation module is further configured to:

determine a first Kalman gain coefficient according to the vector of the first residual signal, residual signal covariance of the previous frame, state estimation error covariance of the previous frame, the first signal vector and a smoothing parameter; and determine a first transfer function of the current frame according to the first Kalman gain coefficient, the first residual signal, and the first transfer function of the previous frame.

In some examples of the present disclosure, the voice cancellation module is further configured to:

determine residual signal covariance of the current frame according to the first transfer function of the current frame, first transfer function covariance of the previous frame, the first Kalman gain coefficient, the residual signal covariance of the previous frame, the first quantity and the second quantity.

In some examples of the present disclosure, when the voice cancellation module is configured to obtain the first signal vector and the second signal vector, it is specifically configured to:

splice an input signal of a current frame of the first microphone and an input signal of at least one previous frame of the first microphone to form the first signal vector with the quantity of sample points being the first quantity; and splice an input signal of a current frame of the second microphone and an input signal of at least one previous frame of the second microphone to form the second signal vector with the quantity of sample points being the second quantity.

In some examples of the present disclosure, the gain module is specifically configured to:

convert the vector of the first residual signal and the first signal vector from a time domain form to a frequency domain form respectively;

determine a vector of a noise estimation signal according to a posterior state error covariance matrix of a previous frame, a process noise covariance matrix, a second transfer function of the previous frame, the first signal vector, a first residual signal of at least one frame including the current frame and a posterior error variance of the previous frame; and determine the gain function of the current frame according to the vector of the noise estimation signal, a vector of a first estimation signal of the previous frame, a vector of a voice power estimation signal of the previous frame, a gain function of the previous frame, the first signal vector and a minimum apriori signal to interference ratio.

In some examples of the present disclosure, when the gain module is configured to determine the vector of the noise estimation signal according to the posterior state error covariance matrix of the previous frame, the process noise covariance matrix, the second transfer function of the previous frame, the first signal vector, the first residual signal of the at least one frame including the current frame and the posterior error variance of the previous frame, it is specifically configured to:

determine an apriori state error covariance matrix of the previous frame according to the posterior state error covariance matrix of the previous frame and the process noise covariance matrix;

determine a vector of an apriori error signal of the previous frame and an apriori error variance of the previous frame according to the first signal vector, the first transfer function of the previous frame, and vectors of first residual signals of the current frame and previous L−1 frames, L being a length of the second transfer function;

determine a vector of a prediction error power signal of the current frame according to the posterior error variance of the previous frame and the apriori error variance of the previous frame;

determine a second Kalman gain coefficient according to the apriori state error covariance matrix of the previous frame, the vectors of the first residual signals of the current frame and the previous L−1 frames, and the vector of the prediction error power signal of the current frame;

determine a second transfer function of the current frame according to the second Kalman gain coefficient, the vector of the apriori error signal of the previous frame, and the second transfer function of the previous frame; and determine the vector of the noise estimation signal according to a vector of a prediction error power signal of the previous frame, the vectors of the first residual signals of the current frame and the previous L−1 frames, and the second transfer function of the current frame.

In some examples of the present disclosure, the gain module is specifically configured to:

determine a posterior state error covariance matrix of the current frame according to the second Kalman gain coefficient, the vectors of the first residual signals of the current frame and the previous L−1 frames, and the apriori state error covariance matrix of the previous frame; and/or determine a posterior error variance of the current frame according to the first signal vector, the vectors of the first residual signals of the current frame and the previous L−1 frames, and the second transfer function of the current frame.

In some examples of the present disclosure, when the gain module is configured to determine the gain function of the current frame according to the vector of the noise estimation signal, the vector of the first estimation signal of the previous frame, the vector of the voice power estimation signal of the previous frame, the gain function of the previous frame, the first signal vector and the minimum apriori signal to interference ratio, it is specifically configured to:

determine a vector of a first estimation signal of the current frame according to the vector of the first estimation signal of the previous frame and the first signal vector;

determine a vector of a voice power estimation signal of the current frame according to the vector of the voice power estimation signal of the previous frame, the first signal vector and the gain function of the previous frame;

determine a posterior signal to interference ratio according to the vector of the first estimation signal of the current frame and a vector of a noise estimation signal of the current frame; and determine the gain function of the current frame according to the vector of the voice power estimation signal of the current frame, the vector of the noise estimation signal of the current frame, the posterior signal to interference ratio and the minimum apriori signal to interference ratio.

In some examples of the present disclosure, the suppressing module is specifically configured to:

convert a product of multiplying the first signal vector by the gain function of the current frame from a frequency domain form to a time domain form, so as to form the first voice signal of the current frame in the time domain form.

In regard to the apparatus in the above example, specific manners of executing operations by the modules have been described in detail in the example related to the method in the first aspect, and elaboration and description will not be made here.

Figure 6:
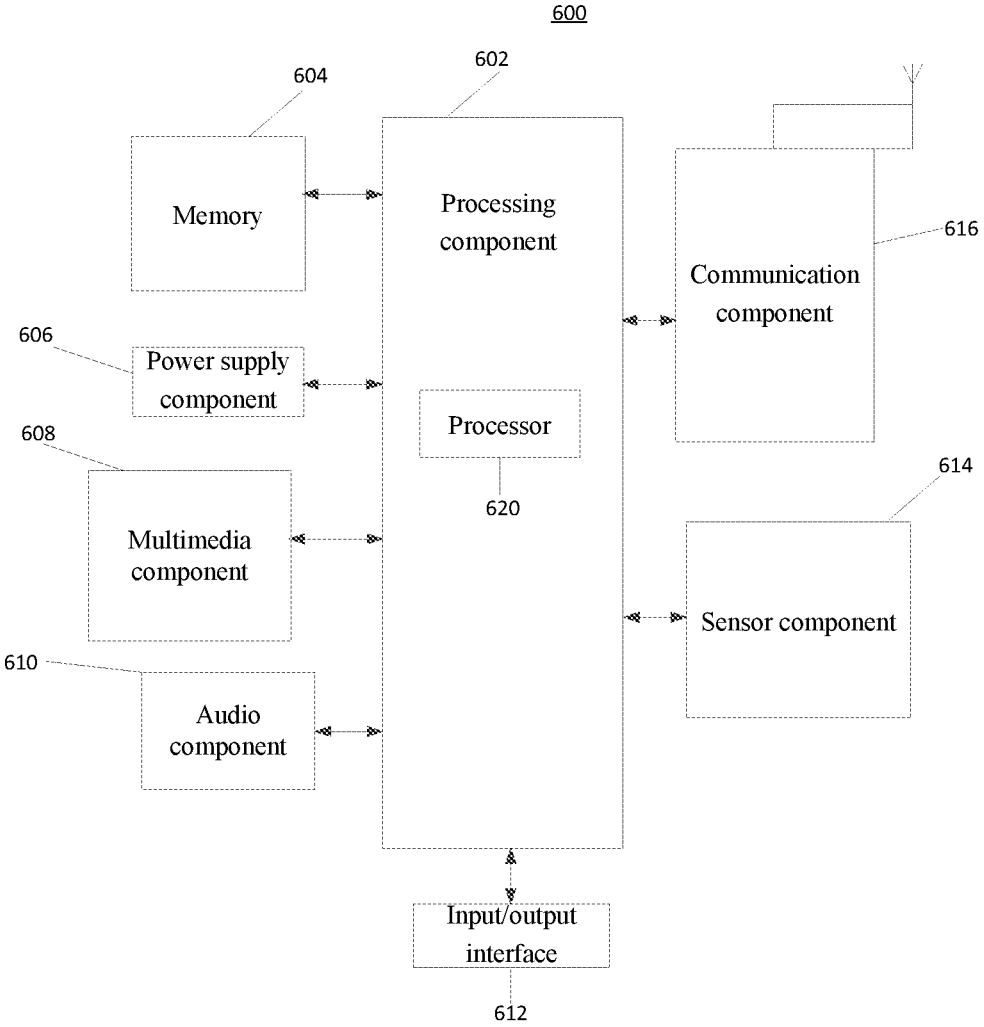
FIG. 6 is a block diagram of an electronic device shown by an example of the present disclosure.

According to a third aspect of an example of the present disclosure, FIG. 6 exemplarily illustrates a block diagram of an electronic device. For example, the device 600 may be a mobile phone, a computer, a digital broadcasting terminal, a messaging device, a game console, a tablet device, a medical device, a fitness device, a personal digital assistant, etc.

With reference to FIG. 6, the device 600 may include one or more of the following components: a processing component 602, a memory 604, a power supply component 606, a multimedia component 608, an audio component 610, an input/output (I/O) interface 612, a sensor component 614, and a communication component 616.

The processing component 602 generally controls overall operations of the device 600, such as operations associated with display, telephone calls, data communication, camera operations, and recording operations. The processing component 602 may include one or more processors 620 to execute instructions to complete all or part of the steps of the above-mentioned method. In addition, the processing component 602 may include one or more modules to facilitate interactions between the processing component 602 and other components. For example, the processing component 602 may include a multimedia module to facilitate an interaction between the multimedia component 608 and the processing component 602.

The memory 604 is configured to store various types of data to support operation of the device 600. Instances of these data include instructions of any application program or method operated on the device 600, contact data, phone book data, messages, pictures, videos, etc. The memory 604 may be implemented by any type of volatile or non-volatile storage devices or their combination, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic disk or an optical disk.

The power supply component 606 provides power for the components of the device 600. The power supply component 606 may include a power management system, one or more power supplies, and other components associated with generating, managing, and distributing power for the device 600.

The multimedia component 608 includes a screen that provides an output interface between the device 600 and a user. In some examples, the screen may include a liquid crystal display (LCD) and a touch panel (TP). If the screen includes a touch panel, the screen may be implemented as a touch screen to receive input signals from the user. The touch panel includes one or more touch sensors to sense touch, swipe, and gestures on the touch panel. The touch sensor may not only sense a boundary of a touch or swipe action, but also detect a duration and pressure related to the touch or swipe operation. In some examples, the multimedia component 608 includes a front camera and/or a rear camera. When the device 600 is in an operation mode, such as a shooting mode or a video mode, the front camera and/or the rear camera may receive external multimedia data. Each of the front camera and rear camera may be a fixed optical lens system or have a focal length and optical zoom capabilities.

The audio component 610 is configured to output and/or input audio signals. For example, the audio component 610 includes a microphone (MIC), and when the device 600 is in an operation mode, such as a call mode, a recording mode, and a voice recognition mode, the microphone is configured to receive an external audio signal. The received audio signal may be further stored in the memory 604 or sent via the communication component 616. In some examples, the audio component 610 further includes a speaker for outputting audio signals.

The I/O interface 612 provides an interface between the processing component 602 and a peripheral interface module. The above-mentioned peripheral interface module may be a keyboard, a click wheel, buttons, and the like. These buttons may include, but are not limited to: a home button, a volume button, a start button, and a lock button.

The sensor component 614 includes one or more sensors for providing the device 600 with various aspects of state assessment. For example, the sensor component 614 may detect an open/closed state of the device 600 and relative positioning of the components. For example, the component is a display and a keypad of the device 600. The sensor component 614 may also detect position change of the device 600 or a component of the device 600, the presence or absence of contact between the user and the device 600, an orientation or acceleration/deceleration of the device 600, and a temperature change of the device 600. The sensor component 614 may also include a proximity sensor configured to detect the presence of a nearby object when there is no physical contact. The sensor component 614 may also include a light sensor, such as a CMOS or CCD image sensor, for use in imaging applications. In some examples, the sensor component 614 may also include an acceleration sensor, a gyroscope sensor, a magnetic sensor, a pressure sensor, or a temperature sensor.

The communication component 616 is configured to facilitate wired or wireless communication between the device 600 and other devices. The device 600 may access a wireless network based on a communication standard, such as WiFi, 2G or 3G, 4G or 5G, or a combination of them. In an example, the communication component 616 receives a broadcast signal or broadcast-related information from an external broadcast management system via a broadcast channel. In an example, the communication component 616 further includes a near field communication (NFC) module to facilitate short-range communication. For example, the NFC module may be implemented based on radio frequency identification (RFID) technology, infrared data association (IrDA) technology, ultra-wideband (UWB) technology, Bluetooth (BT) technology and other technologies.

In an example, the device 600 may be implemented by one or more application specific integrated circuits (ASICs), digital signal processors (DSPs), digital signal processing devices (DSPDs), programmable logic devices (PLDs), field programmable gate arrays (FPGAs), controllers, microcontrollers, microprocessors or other electronic elements, so as to implement a power supply method of the above-mentioned electronic device.

In a fourth aspect, in an example of the present disclosure, a non-transitory computer readable storage medium including instructions is further provided, for example, a memory 604 including instructions. The above instructions may be executed by a processor 620 of a device 600 to complete a power supply method of the above-mentioned electronic device. For example, the non-transitory computer readable storage medium may be a ROM, a random access memory (RAM), a CD-ROM, a magnetic tape, a floppy disk, an optical data storage device, etc.

After considering the specification and practicing the present disclosure disclosed herein, those of skill in the art will easily think of other implementation schemes of the present disclosure. The present application is intended to cover any variations, applications, or adaptive changes of the present disclosure. These variations, applications, or adaptive changes follow the general principles of the present disclosure and include common knowledge or conventional technical means in the art that are not disclosed in the present disclosure. The specification and the examples are regarded as exemplary only, and the true scope and spirit of the present disclosure are pointed out by the appended claims.

It should be understood that the present disclosure is not limited to the precise structure that has been described above and shown in the drawings, and various modifications and changes can be made without departing from its scope. The scope of the present disclosure is only limited by the appended claims.

The invention claimed is:

1. A sound processing method, applied to a terminal device, wherein the terminal device comprises a first microphone and a second microphone, and the sound processing method comprises:

determining a vector of a first residual signal according to a first signal vector and a second signal vector, wherein the first signal vector comprises a first voice signal and a first noise signal input into the first microphone, the second signal vector comprises a second voice signal and a second noise signal input into the second microphone, and the first residual signal comprises the second noise signal and a residual voice signal;

determining a gain function of a current frame according to the vector of the first residual signal and the first signal vector; and determining a first voice signal of the current frame according to the first signal vector and the gain function of the current frame.

2. The sound processing method according to claim 1, wherein determining the vector of the first residual signal according to the first signal vector and the second signal vector comprises:

obtaining the first signal vector and the second signal vector, wherein the first signal vector comprises sample points of a first quantity, and the second signal vector comprises sample points of a second quantity;

determining a vector of a Fourier transform coefficient of the second voice signal according to the first signal vector and a first transfer function of a previous frame; and determining the vector of the first residual signal according to the sample points of the second quantity in the second signal vector and in the vector of the Fourier transform coefficient.

3. The sound processing method according to claim 2, further comprising:

determining a first Kalman gain coefficient according to the vector of the first residual signal, residual signal covariance of the previous frame, state estimation error covariance of the previous frame, the first signal vector and a smoothing parameter; and determining a first transfer function of the current frame according to the first Kalman gain coefficient, the first residual signal, and the first transfer function of the previous frame.

4. The sound processing method according to claim 3, further comprising:

determining residual signal covariance of the current frame according to the first transfer function of the current frame, first transfer function covariance of the previous frame, the first Kalman gain coefficient, the residual signal covariance of the previous frame, the first quantity and the second quantity.

5. The sound processing method according to claim 2, wherein obtaining the first signal vector and the second signal vector comprises:

splicing an input signal of a current frame of the first microphone and an input signal of at least one previous frame of the first microphone to form the first signal vector with the quantity of sample points being the first quantity; and splicing an input signal of a current frame of the second microphone and an input signal of at least one previous frame of the second microphone to form the second signal vector with the quantity of sample points being the second quantity.

6. The sound processing method according to claim 1, wherein determining the gain function of the current frame according to the vector of the first residual signal and the first signal vector comprises:

converting the vector of the first residual signal and the first signal vector from a time domain form to a frequency domain form respectively;

determining a vector of a noise estimation signal according to a posterior state error covariance matrix of a previous frame, a process noise covariance matrix, a second transfer function of the previous frame, the first signal vector, a first residual signal of at least one frame including the current frame and a posterior error variance of the previous frame; and determining the gain function of the current frame according to the vector of the noise estimation signal, a vector of a first estimation signal of the previous frame, a vector of a voice power estimation signal of the previous frame, a gain function of the previous frame, the first signal vector and a minimum apriori signal to interference ratio.

7. The sound processing method according to claim 6, wherein determining the vector of the noise estimation signal according to the posterior state error covariance matrix of the previous frame, the process noise covariance matrix, the second transfer function of the previous frame, the first signal vector, the first residual signal of the at least one frame including the current frame and the posterior error variance of the previous frame comprises:

determining an apriori state error covariance matrix of the previous frame according to the posterior state error covariance matrix of the previous frame and the process noise covariance matrix;

determining a vector of an apriori error signal of the previous frame and an apriori error variance of the previous frame according to the first signal vector, a first transfer function of the previous frame, and vectors of first residual signals of the current frame and previous L−1 frames, wherein L is a length of the second transfer function;

determining a vector of a prediction error power signal of the current frame according to the posterior error variance of the previous frame and the apriori error variance of the previous frame;

determining a second Kalman gain coefficient according to the apriori state error covariance matrix of the previous frame, the vectors of the first residual signals of the current frame and the previous L−1 frames, and the vector of the prediction error power signal of the current frame;

determining a second transfer function of the current frame according to the second Kalman gain coefficient, the vector of the apriori error signal of the previous frame, and the second transfer function of the previous frame; and determining the vector of the noise estimation signal according to a vector of a prediction error power signal of the previous frame, the vectors of the first residual signals of the current frame and the previous L−1 frames, and the second transfer function of the current frame.

8. The sound processing method according to claim 7, further comprising:

determining a posterior state error covariance matrix of the current frame according to the second Kalman gain coefficient, the vectors of the first residual signals of the current frame and the previous L−1 frames, and the apriori state error covariance matrix of the previous frame; and determining a posterior error variance of the current frame according to the first signal vector, the vectors of the first residual signals of the current frame and the previous L−1 frames, and the second transfer function of the current frame.

9. The sound processing method according to claim 6, wherein determining the gain function of the current frame according to the vector of the noise estimation signal, the vector of the first estimation signal of the previous frame, the vector of the voice power estimation signal of the previous frame, the gain function of the previous frame, the first signal vector and the minimum apriori signal to interference ratio comprises:

determining a vector of a first estimation signal of the current frame according to the vector of the first estimation signal of the previous frame and the first signal vector;

determining a vector of a voice power estimation signal of the current frame according to the vector of the voice power estimation signal of the previous frame, the first signal vector and the gain function of the previous frame;

determining a posterior signal to interference ratio according to the vector of the first estimation signal of the current frame and a vector of a noise estimation signal of the current frame; and determining the gain function of the current frame according to the vector of the voice power estimation signal of the current frame, the vector of the noise estimation signal of the current frame, the posterior signal to interference ratio and the minimum apriori signal to interference ratio.

10. The sound processing method according to claim 1, wherein determining a first voice signal of the current frame according to the first signal vector and the gain function of the current frame comprises:

converting a product of multiplying the first signal vector by the gain function of the current frame from a frequency domain form to a time domain form, so as to form the first voice signal of the current frame in the time domain form.

11. An electronic device, comprising a memory, a processor, a first microphone and a second microphone, wherein the memory is configured to store a computer instruction that may be run on the processor, the processor is configured to:

determine a vector of a first residual signal according to a first signal vector and a second signal vector, wherein the first signal vector comprises a first voice signal and a first noise signal input into the first microphone, the second signal vector comprises a second voice signal and a second noise signal input into the second microphone, and the first residual signal comprises the second noise signal and a residual voice signal;

determine a gain function of a current frame according to the vector of the first residual signal and the first signal vector; and determine a first voice signal of the current frame according to the first signal vector and the gain function of the current frame.

12. The electronic device according to claim 11, wherein the processor is further configured to:

obtain the first signal vector and the second signal vector, wherein the first signal vector comprises sample points of a first quantity, and the second signal vector comprises sample points of a second quantity;

determine a vector of a Fourier transform coefficient of the second voice signal according to the first signal vector and a first transfer function of a previous frame; and determine the vector of the first residual signal according to the sample points of the second quantity in the second signal vector and in the vector of the Fourier transform coefficient.

13. The electronic device according to claim 12, wherein the processor is further configured to:

determine a first Kalman gain coefficient according to the vector of the first residual signal, residual signal covariance of the previous frame, state estimation error covariance of the previous frame, the first signal vector and a smoothing parameter; and determine a first transfer function of the current frame according to the first Kalman gain coefficient, the first residual signal, and the first transfer function of the previous frame.

14. The electronic device according to claim 13, wherein the processor is further configured to:

determine residual signal covariance of the current frame according to the first transfer function of the current frame, first transfer function covariance of the previous frame, the first Kalman gain coefficient, the residual signal covariance of the previous frame, the first quantity and the second quantity.

15. The electronic device according to claim 12, wherein the processor is further configured to:

splice an input signal of a current frame of the first microphone and an input signal of at least one previous frame of the first microphone to form the first signal vector with the quantity of sample points being the first quantity; and splice an input signal of a current frame of the second microphone and an input signal of at least one previous frame of the second microphone to form the second signal vector with the quantity of sample points being the second quantity.

16. The electronic device according to claim 11, wherein the processor is further configured to:

convert the vector of the first residual signal and the first signal vector from a time domain form to a frequency domain form respectively;

determine a vector of a noise estimation signal according to a posterior state error covariance matrix of a previous frame, a process noise covariance matrix, a second transfer function of the previous frame, the first signal vector, a first residual signal of at least one frame including the current frame and a posterior error variance of the previous frame; and determine the gain function of the current frame according to the vector of the noise estimation signal, a vector of a first estimation signal of the previous frame, a vector of a voice power estimation signal of the previous frame, a gain function of the previous frame, the first signal vector and a minimum apriori signal to interference ratio.

17. The electronic device according to claim 16, wherein the processor is further configured to:

determine an apriori state error covariance matrix of the previous frame according to the posterior state error covariance matrix of the previous frame and the process noise covariance matrix;

determine a vector of an apriori error signal of the previous frame and an apriori error variance of the previous frame according to the first signal vector, a first transfer function of the previous frame, and vectors of first residual signals of the current frame and previous L−1 frames, wherein L is a length of the second transfer function;

determine a vector of a prediction error power signal of the current frame according to the posterior error variance of the previous frame and the apriori error variance of the previous frame;

determine a second Kalman gain coefficient according to the apriori state error covariance matrix of the previous frame, the vectors of the first residual signals of the current frame and the previous L−1 frames, and the vector of the prediction error power signal of the current frame;

determine a second transfer function of the current frame according to the second Kalman gain coefficient, the vector of the apriori error signal of the previous frame, and the second transfer function of the previous frame; and determine the vector of the noise estimation signal according to a vector of a prediction error power signal of the previous frame, the vectors of the first residual signals of the current frame and the previous L−1 frames, and the second transfer function of the current frame.

18. The electronic device according to claim 17, wherein the processor is further configured to:

determine a posterior state error covariance matrix of the current frame according to the second Kalman gain coefficient, the vectors of the first residual signals of the current frame and the previous L−1 frames, and the apriori state error covariance matrix of the previous frame; and determine a posterior error variance of the current frame according to the first signal vector, the vectors of the first residual signals of the current frame and the previous L−1 frames, and the second transfer function of the current frame.

19. The electronic device according to claim 16, wherein the processor is further configured to:

determine a vector of a first estimation signal of the current frame according to the vector of the first estimation signal of the previous frame and the first signal vector;

determine a vector of a voice power estimation signal of the current frame according to the vector of the voice power estimation signal of the previous frame, the first signal vector and the gain function of the previous frame;

determine a posterior signal to interference ratio according to the vector of the first estimation signal of the current frame and a vector of a noise estimation signal of the current frame; and determine the gain function of the current frame according to the vector of the voice power estimation signal of the current frame, the vector of the noise estimation signal of the current frame, the posterior signal to interference ratio and the minimum apriori signal to interference ratio.

20. A non-transitory computer readable storage medium storing a computer program, wherein the program, when executed by a processor, causes the processor to:

determine a vector of a first residual signal according to a first signal vector and a second signal vector, wherein the first signal vector comprises a first voice signal and a first noise signal input into a first microphone, the second signal vector comprises a second voice signal and a second noise signal input into a second microphone, and the first residual signal comprises the second noise signal and a residual voice signal;

determine a gain function of a current frame according to the vector of the first residual signal and the first signal vector; and determine a first voice signal of the current frame according to the first signal vector and the gain function of the current frame.

* * * * *